US012588762B2

(12) United States Patent
Li et al.

(10) Patent No.: US 12,588,762 B2
(45) Date of Patent: Mar. 31, 2026

(54) EXTENSION UNIT, ADJUSTMENT STRUCTURE, AND SEAT FRAME

(71) Applicant: DEWERTOKIN TECHNOLOGY GROUP CO., LTD., Jiaxing (CN)

(72) Inventors: Long Li, Jiaxing (CN); Qiqi Ye, Jiaxing (CN); Liming Yang, Jiaxing (CN); Weiyao Zhou, Jiaxing (CN); Bin Shen, Jiaxing (CN); Kangming Tao, Jiaxing (CN); Guowei Wang, Jiaxing (CN)

(73) Assignee: DEWERTOKIN TECHNOLOGY GROUP CO., LTD., Jiaxing (CN)

( * ) Notice: Subject to any disclaimer, the term of this patent is extended or adjusted under 35 U.S.C. 154(b) by 182 days.

(21) Appl. No.: 18/567,939

(22) PCT Filed: Jun. 7, 2022

(86) PCT No.: PCT/CN2022/097281

§ 371 (c)(1),
(2) Date: Dec. 7, 2023

(87) PCT Pub. No.: WO2022/257901

PCT Pub. Date: Dec. 15, 2022

(65) Prior Publication Data

US 2024/0277145 A1 Aug. 22, 2024

(30) Foreign Application Priority Data

Jun. 7, 2021 (CN) ..... 202110631336.8
Jun. 7, 2021 (CN) ..... 202121259697.6
(Continued)

(51) Int. Cl.
*A47C 1/02* (2006.01)
*A47C 1/024* (2006.01)
(Continued)

(52) U.S. Cl.
CPC ..... *A47C 1/0242* (2013.01); *A47C 1/03211* (2013.01); *A47C 1/035* (2013.01); *A47C 1/0355* (2013.01)

(58) Field of Classification Search
CPC ... A47C 1/0242; A47C 1/03211; A47C 1/035; A47C 1/0355
See application file for complete search history.

(56) References Cited

U.S. PATENT DOCUMENTS 7,543,885 B2 * 6/2009 Pollard ..... A47C 1/035
8,403,409 B2 * 3/2013 Pollard ..... A61G 5/14
(Continued)

FOREIGN PATENT DOCUMENTS

CN 101485522 A 7/2009
CN 203986974 U 12/2014
(Continued)

OTHER PUBLICATIONS

International Search Report for corresponding application PCT/CN2022/097281 filed Jun. 7, 2022; Mail date Aug. 29, 2022.
(Continued)

*Primary Examiner* — Rodney B White
(74) *Attorney, Agent, or Firm* — CANTOR COLBURN LLP

(57) ABSTRACT

A seat frame includes: a base including a transverse support rod and a longitudinal support rod; an elevation unit including a support, a first elevation rod, a second elevation rod, and a connecting piece; an extension unit including a base plate, a lifting unit, a foot adjustment unit, and a backrest adjustment unit, where the base plate being fixed to the connecting piece; and a power unit disposed on the base and separately connected to the elevation unit and the extension unit, where the power unit includes a drive unit, a connecting base, and a drive connecting rod, a first end of the drive unit
(Continued)

is hinged to the base, and a second end of the drive unit is hinged to the connecting base.

20 Claims, 11 Drawing Sheets

(30) Foreign Application Priority Data

Jun. 7, 2021 (CN) ..... 202121261087.X
Jun. 7, 2021 (CN) ..... 202121261108.8

(51) Int. Cl.
*A47C 1/032* (2006.01)
*A47C 1/035* (2006.01)
*A47C 1/0355* (2013.01)

(56) References Cited

U.S. PATENT DOCUMENTS 9,016,788 B1 * 4/2015 Pollard ..... A47C 1/0355
9,848,704 B1 * 12/2017 Pollard ..... A47C 31/008
10,117,797 B2 * 11/2018 Davies ..... A47C 1/029
10,524,971 B2 * 1/2020 Davies ..... A47C 1/029
11,000,434 B2 * 5/2021 Davies ..... A47C 1/029
11,166,562 B2 * 11/2021 Zhang ..... A61G 5/14
12,022,949 B2 * 7/2024 Lake ..... A47C 1/0242
2024/0335039 A1 * 10/2024 Lake ..... A47C 1/0355

FOREIGN PATENT DOCUMENTS

CN 104398033 A 3/2015
CN 111887640 A 11/2020
CN 112021847 A 12/2020
CN 212878459 U 4/2021
CN 213311003 U 6/2021
CN 113229659 A 8/2021
CN 217429587 U 9/2022
WO 2019060437 A1 3/2019

OTHER PUBLICATIONS

Chinese Office Action for corresponding application 202110631336.8; Issued Jan. 3, 2025.

* cited by examiner

EXTENSION UNIT, ADJUSTMENT STRUCTURE, AND SEAT FRAME

CROSS-REFERENCE TO RELATED APPLICATION

This is a National stage application, filed under 37 U.S.C. 371, of International Patent Application NO. PCT/CN2022/097281, filed on Jun. 7, 2022, which is based on claims priority to Chinese Patent Application No. 202110631336.8 filed with the China National Intellectual Property Administration (CNIPA) on Jun. 7, 2021, Chinese Patent Application No. 202121261108.8 filed with the CNIPA on Jun. 7, 2021, Chinese Patent Application No. 202121259697.6 filed with the CNIPA on Jun. 7, 2021, and Chinese Patent Application No. 202121261087.X filed with the CNIPA on Jun. 7, 2021, the disclosures of which are incorporated herein by reference in their entireties.

TECHNICAL FIELD

The present application relates to the field of seats, for example, an extension unit, an adjustment structure, and a seat frame.

BACKGROUND

Seats are commonly used sitting devices in life. The seat generally includes a backrest, armrests, and the like. With the improvement of living standards and the increase in the use requirements of special groups, especially the requirements of the elderly for seats, special elderly seats have been developed. The elderly seat has an adjustment function that allows the elderly seat to be adjusted among various use states.

The elderly seat in the related art having an adjustment function has an extension structure which provides stretching, retraction and collapsing of the leg support portion, angle adjustment of the backrest support portion and lifting or lowering of the seat surface mounting portion. The lifting or lowering function of the extension structure is achieved through a connecting rod structure, but the connecting rod structure is relatively complex in structure, has unsatisfactory bearing capacity, and involves unreasonable adjusting actions.

SUMMARY

The present application provides an extension unit, an adjustment structure, and a seat frame with reasonable structure designs.

The present application provides a seat frame. The seat frame includes a base, an elevation unit, an extension unit, and a power unit.

The base includes a transverse support rod and a longitudinal support rod. The transverse support rod extends in a first direction, the longitudinal support rod extends in a second direction, and the transverse support rod is connected to the longitudinal support rod.

The elevation unit includes a support, a first elevation rod, a second elevation rod, and a connecting piece. One end of the first elevation rod is hinged to the support, and the other end of the first elevation rod is hinged to the connecting piece. One end of the second elevation rod is hinged to the support, and the other end of the second elevation rod is hinged to the connecting piece. The hinge point position where the first elevation rod is hinged to the support is different from the hinge point position where the second elevation rod is hinged to the support, and the hinge point position where the first elevation rod is hinged to the connecting piece is different from the hinge point position where the second elevation rod is hinged to the connecting piece.

The extension unit includes a base plate, a lifting unit, a foot adjustment unit, and a backrest adjustment unit. The base plate is fixed to the connecting piece.

The power unit is disposed on the base and separately connected to the elevation unit and the extension unit. The power unit includes a drive unit, a connecting base, and a drive connecting rod. A first end of the drive unit is hinged to the base, and a second end of the drive unit is hinged to the connecting base.

The lifting unit includes a first lifting connecting rod, a second lifting connecting rod, a third lifting connecting rod, a fourth lifting connecting rod, and a seat surface mounting portion. A first end of the first lifting connecting rod is hinged to the base plate, a second end of the first lifting connecting rod is hinged to a first end of the third lifting connecting rod, a second end of the third lifting connecting rod is hinged to a first end of the seat surface mounting portion, a second end of the seat surface mounting portion is hinged to a first end of the fourth lifting connecting rod, a second end of the fourth lifting connecting rod is hinged to a first end of the second lifting connecting rod, and a second end of the second lifting connecting rod is connected to the base plate. The first lifting connecting rod and the second lifting connecting rod are hinged at a first rotating fulcrum, and the first rotating fulcrum is located in the middle region of at least one of the first lifting connecting rod or the second lifting connecting rod.

The present application further provides an extension unit of a seat frame. The extension unit includes a base plate, a lifting unit, a foot adjustment unit, and a backrest adjustment unit.

The lifting unit is connected to the base plate.

The foot adjustment unit is connected to the lifting unit.

The backrest adjustment unit is connected to the lifting unit.

The lifting unit includes a first lifting connecting rod, a second lifting connecting rod, a third lifting connecting rod, a fourth lifting connecting rod, and a seat surface mounting portion. A first end of the first lifting connecting rod is hinged to the base plate, a second end of the first lifting connecting rod is hinged to a first end of the third lifting connecting rod, a second end of the third lifting connecting rod is hinged to a first end of the seat surface mounting portion, a second end of the seat surface mounting portion is hinged to a first end of the fourth lifting connecting rod, a second end of the fourth lifting connecting rod is hinged to a first end of the second lifting connecting rod, and a second end of the second lifting connecting rod is connected to the base plate. The first lifting connecting rod and the second lifting connecting rod are hinged at a first rotating fulcrum, and the first rotating fulcrum is located in the middle region of the first lifting connecting rod and/or the second lifting connecting rod.

The present application further provides an adjustment structure of a seat frame. The adjustment structure includes an elevation unit and an extension unit.

The elevation unit includes a support, a first elevation rod, a second elevation rod, and a connecting piece. One end of the first elevation rod is hinged to the support, and the other end of the first elevation rod is hinged to the connecting piece. One end of the second elevation rod is hinged to the support, and the other end of the second elevation rod is hinged to the connecting piece.

The extension unit includes a base plate, a lifting unit, a foot adjustment unit, and a backrest adjustment unit. The base plate is fixed to the connecting piece.

The lifting unit includes a first lifting connecting rod, a second lifting connecting rod, a third lifting connecting rod, a fourth lifting connecting rod, and a seat surface mounting portion. A first end of the first lifting connecting rod is hinged to the base plate, a second end of the first lifting connecting rod is hinged to a first end of the third lifting connecting rod, a second end of the third lifting connecting rod is hinged to a first end of the seat surface mounting portion, a second end of the seat surface mounting portion is hinged to a first end of the fourth lifting connecting rod, a second end of the fourth lifting connecting rod is hinged to a first end of the second lifting connecting rod, and a second end of the second lifting connecting rod is connected to the base plate. The first lifting connecting rod and the second lifting connecting rod are hinged at a first rotating fulcrum, and the first rotating fulcrum is located in the middle region of the first lifting connecting rod and/or the second lifting connecting rod.

BRIEF DESCRIPTION OF DRAWINGS

The drawings used in the description of embodiments will be briefly introduced below. The drawings described below illustrate only part of the embodiments of the present application, and those of ordinary skill in the art may obtain other drawings based on the drawings described below on the premise that no creative work is done.

IN THE DRAWINGS

Figure 1:
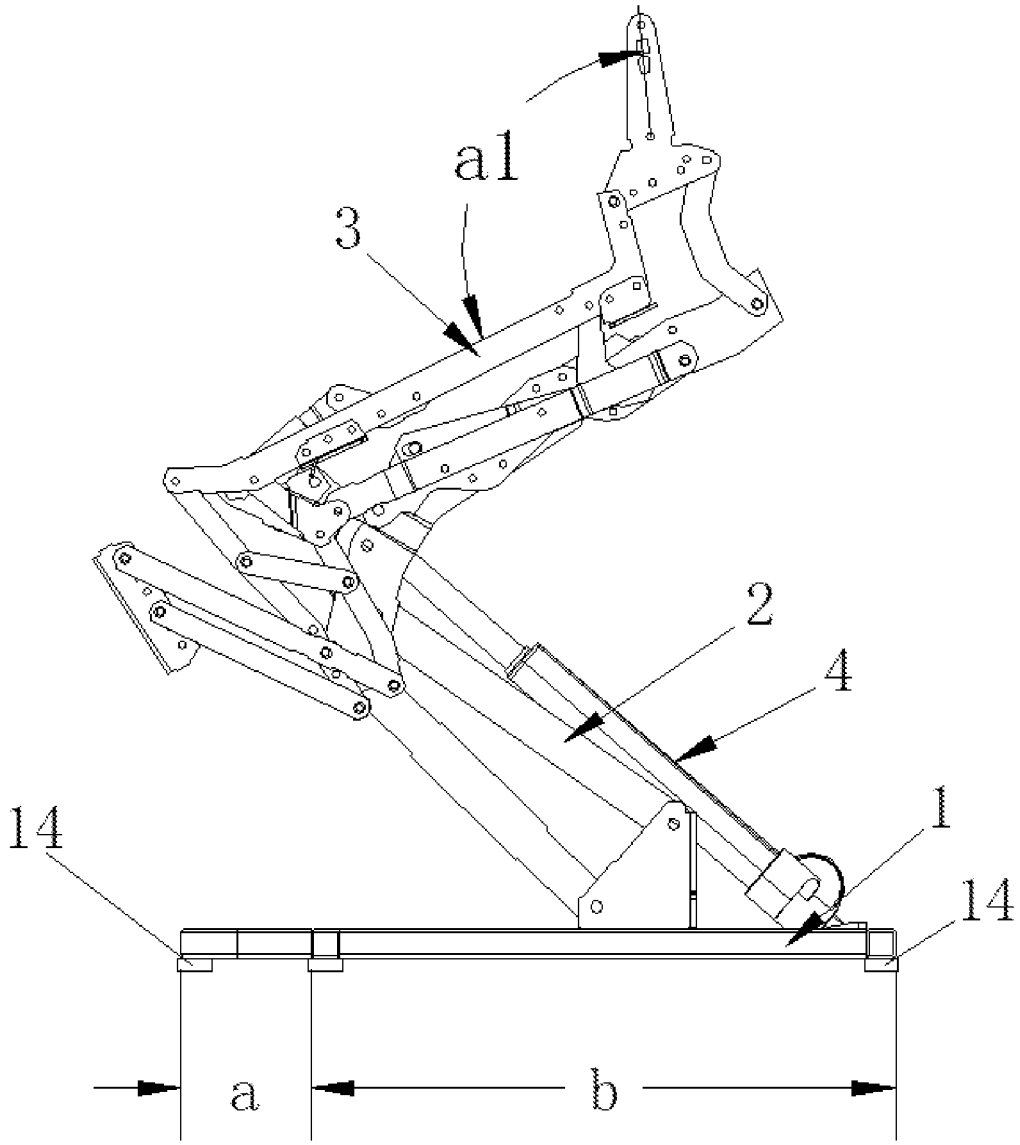
FIG. 1 is a front view of a seat frame in Embodiment 1 of the present application, with the seat frame in a standing posture state.
Figure 2:
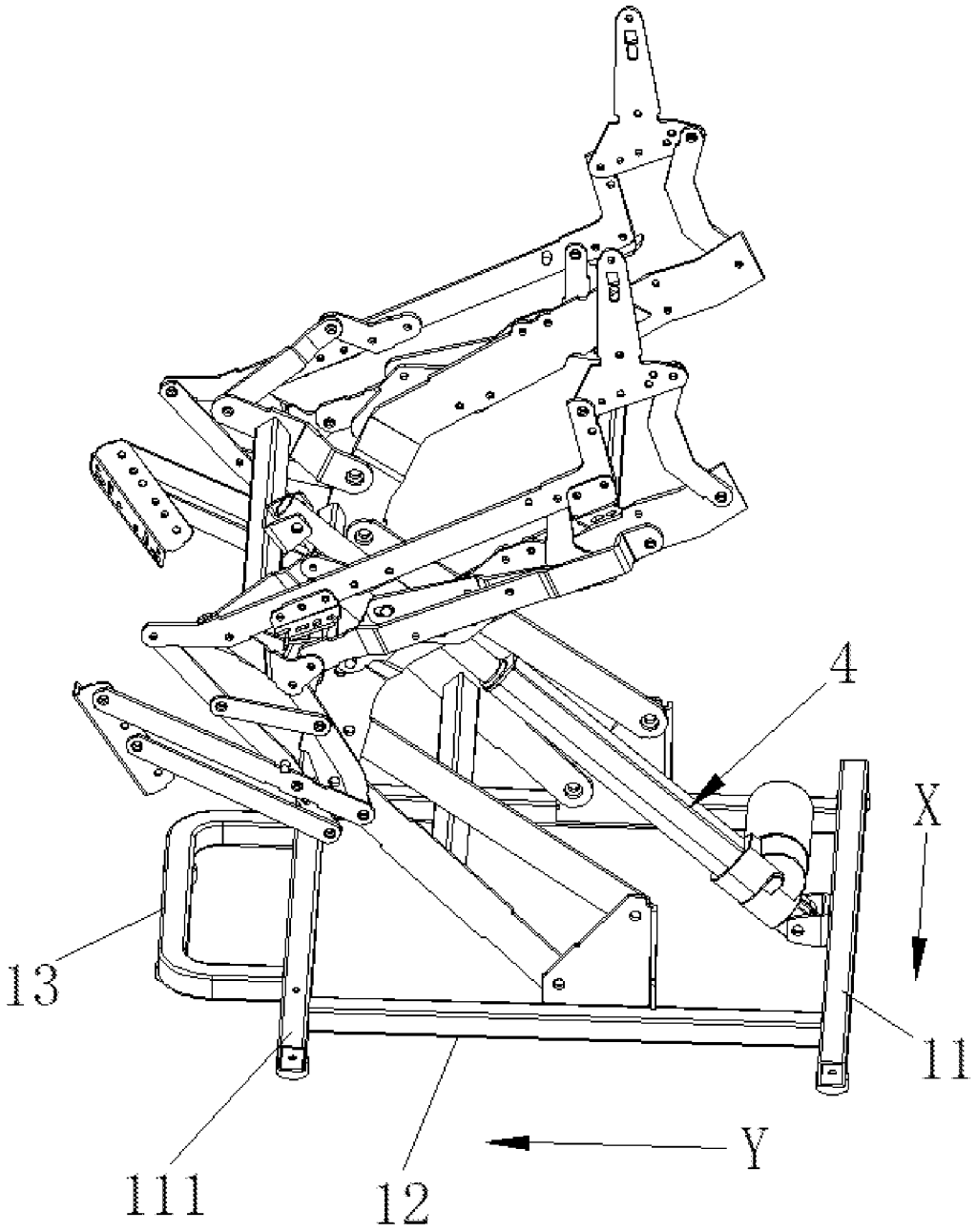
FIG. 2 is a perspective view one of the seat frame in Embodiment 1 of the present application, with the seat frame in a standing posture state.
Figure 3:
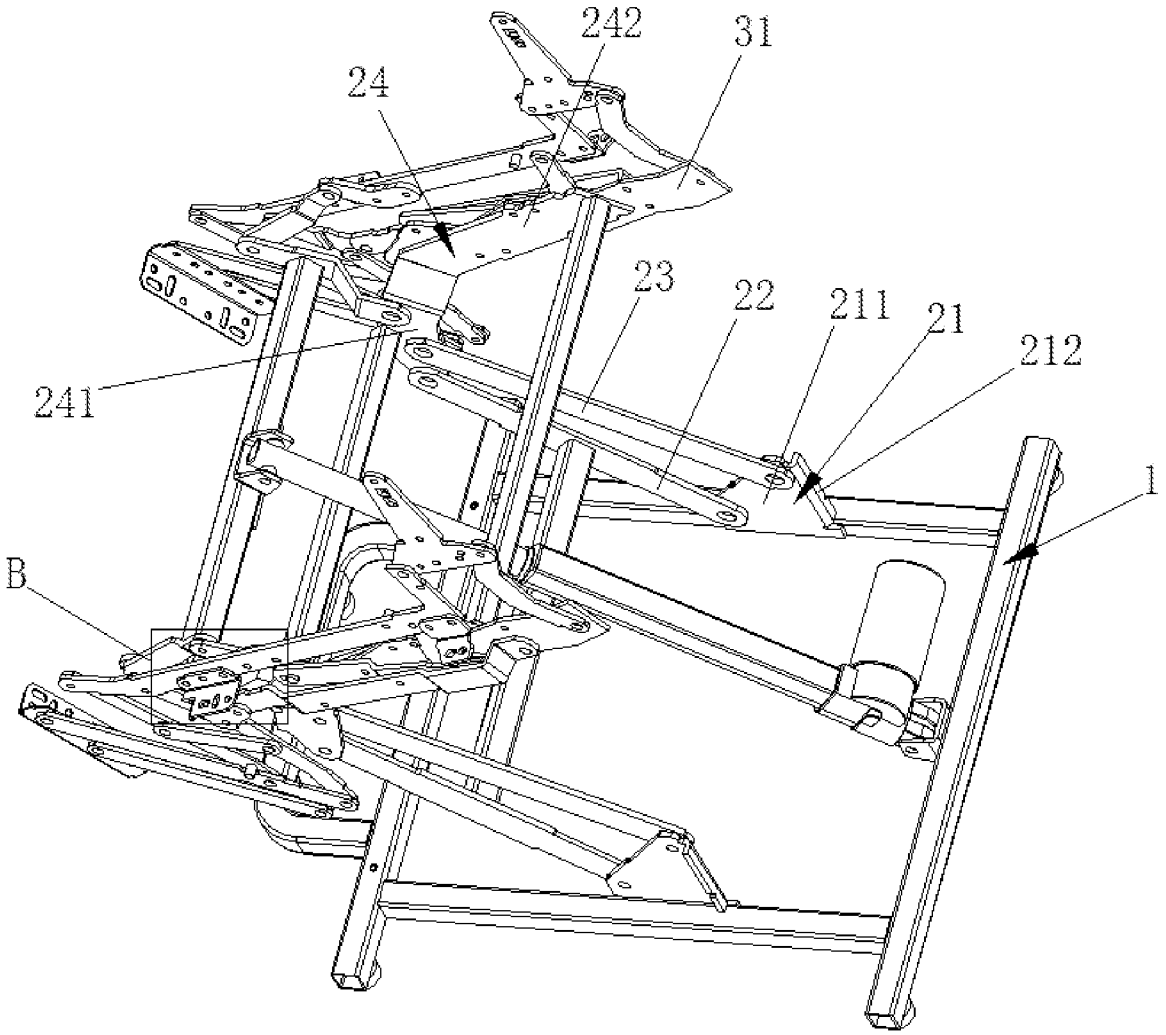
FIG. 3 is a perspective view two of the seat frame in Embodiment 1 of the present application, with the seat frame in a standing posture state.
Figure 4:
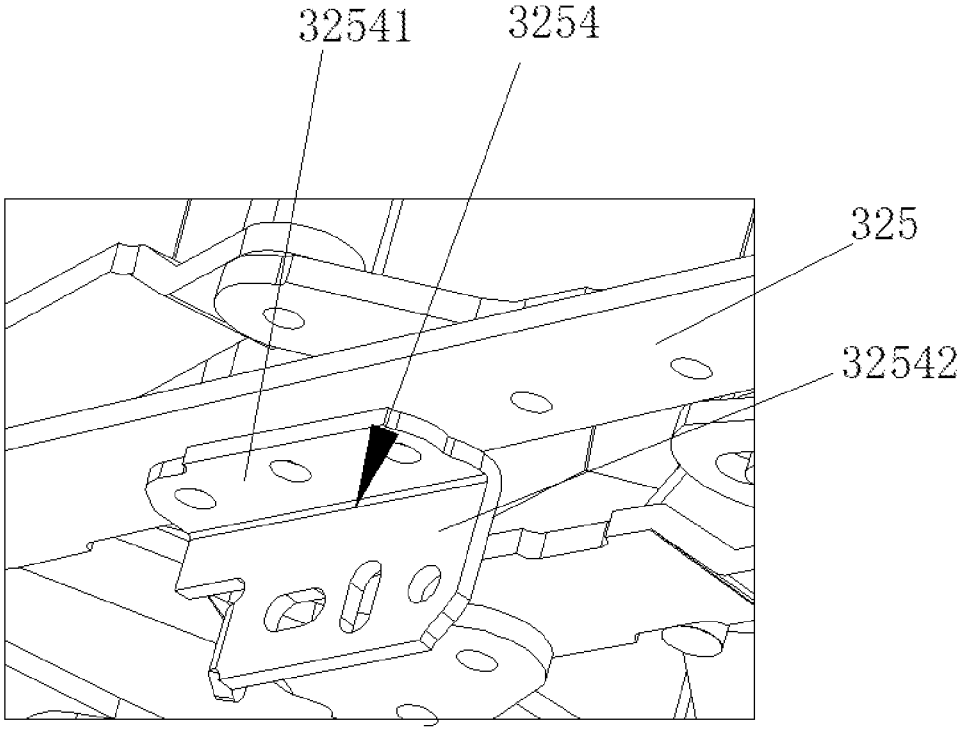
FIG. 4 is an enlarged view of the portion at B in FIG. 3.

1 base
11 transverse support rod
12 longitudinal support rod
111 first anti-tipping portion
13 second anti-tipping portion
14 support pad
2 elevation unit
21 support
211 sheet
212 first limiting portion
22 first elevation rod
23 second elevation rod
24 connecting piece
241 first portion
242 second portion
3 extension unit
301 first rotating fulcrum
3201 second rotating fulcrum
31 base plate
311 hinge shaft
312 second limiting portion
32 lifting unit
321 first lifting connecting rod
3211 first end of the first lifting connecting rod
3212 second end of the first lifting connecting rod
3213 first bent portion
3214 second bent portion
322 second lifting connecting rod
3221 first end of the second lifting connecting rod
3222 second end of the second lifting connecting rod
3223 sliding slot
323 third lifting connecting rod
3231 first end of the third lifting connecting rod
3232 second end of the third lifting connecting rod
324 fourth lifting connecting rod
3241 first end of the fourth lifting connecting rod
3242 second end of the fourth lifting connecting rod
325 seat surface mounting portion
3251 first end of the seat surface mounting portion
3252 second end of the seat surface mounting portion
3253 third limiting portion
3254 mounting member
32541 first sheet portion
32542 second sheet portion
3255 turning portion
33 foot adjustment unit
331 first foot adjustment rod
3311 first end of the first foot adjustment rod
3312 second end of the first foot adjustment rod
332 second foot adjustment rod
3321 first end of the second foot adjustment rod
3322 second end of the second foot adjustment rod
333 third foot adjustment rod
3331 first end of the third foot adjustment rod
3332 second end of the third foot adjustment rod
334 fourth foot adjustment rod
3341 first end of the fourth foot adjustment rod
3342 second end of the fourth foot adjustment rod

335 foot mounting portion
336 fifth foot adjustment rod
34 backrest adjustment unit
341 backrest adjustment rod
3411 first end of the backrest adjustment rod
3412 second end of the backrest adjustment rod
3413 main body portion
342 backrest mounting portion
4 power unit
41 drive unit
42 connecting base
43 drive connecting rod
44 first hinge base
45 second hinge base
46 first drive rod
47 second drive rod

DETAILED DESCRIPTION

Hereinafter, the present application will be described in detail in conjunction with the drawings and embodiments.

Embodiment 1

Referring to FIGS. 1 to 15, the seat frame in the present embodiment is suitable for an elderly seat and includes a base 1, a lifting unit 2, an extension unit 3, and a power unit 4.

In the present embodiment, the base 1 includes a transverse support rod 11 and a longitudinal support rod 12. The transverse support rod 11 is connected to the longitudinal support rod 12 to form a support frame. Two sets of transverse support rods 11 are provided, and two sets of longitudinal support rods 12 are provided. The transverse support rod 11 extends in a first direction X, and the longitudinal support rod 12 extends in a second direction Y. The first direction X is perpendicular or substantially perpendicular to the second direction Y.

The longitudinal support rod 12 may be welded on the transverse support rod 11. The longitudinal support rod 12 may also be fixed to the transverse support rod 11 by bolts. In the first direction X, one end or both ends of the transverse support rod 11 extends beyond the longitudinal support rod 12 to form a first anti-tipping portion 111. In the present embodiment, two sets of elevation units 2 are provided and disposed on the base 1. In one embodiment, the two sets of elevation units 2 may be provided on the two sets of longitudinal support rods 12, respectively. The distance between the two sets of longitudinal support rods 12 defines the distance between the two sets of elevation units 2 and thus defines the seat surface width of the seat, and the width of the seat is within a fixed range. Therefore, by extending one end or both ends of the transverse support rod 11 beyond the longitudinal support rod 12 to form a first anti-tipping portion 111, the seat can be prevented from tipping in the first direction X, thereby ensuring safety in use of the seat, particularly as an elderly seat.

In the present embodiment, the base 1 may further be provided with a second anti-tipping portion 13, and the second anti-tipping portion 13 is protruded from the base 1 in the second direction Y. The second anti-tipping portion 13 is U-shaped and is fixed to one set of transverse support rods 11 to form a closed structure with the transverse support rod 11 so that the structure of the second anti-tipping portion 13 is more stable and can bear more weight. In the present embodiment, the second anti-tipping portion 13 is located in the middle region of the base 1 in the first direction X. The second anti-tipping portion 13 includes a tube portion, the tube portion is bent into a U-shape, and both ends of the tube portion may be fixed to the transverse support rod 11 by welding.

In the present embodiment, the ratio of the width dimension a of the second anti-tipping portion 13 in the second direction Y to the width dimension b of the support frame of the base 1 is 1:3 to 1:6. In one embodiment, the ratio of the width dimension a of the second anti-tipping portion 13 in the second direction Y to the width dimension b of the support frame of the base 1 is 1:3.5 to 1:4.5, thereby improving the anti-tipping performance in the second direction Y.

In the present embodiment, the length dimension of the second anti-tipping portion 13 in the first direction X accounts for at least 50% of the length dimension of the support frame, thereby improving the anti-tipping performance in the first direction X.

In the present embodiment, multiple support pads 14 are disposed on the bottom of the base 1. Optionally, a support pad 14 is separately disposed on both sides of the bottom of the transverse support rod 11 (or a support pad 14 is disposed on the bottom of the first anti-tipping portion 111 of the transverse support rod 11), and a support pad 14 is separately disposed on both sides of the bottom of the longitudinal support rod 12. In one embodiment, a support pad 14 is disposed on the bottom of the second anti-tipping portion 13 to provide support for the second anti-tipping portion in use.

In the present embodiment, the elevation unit 2 includes a support 21, and the support 21 is fixed to the base 1. In one embodiment, the support 21 is fixed to the longitudinal support rod 12. The support 21 includes a sheet 211, and a part of the sheet 211 is attached to the inner side of the longitudinal support rod 12 relative to the base 1 and fixed to the longitudinal support rod 12. In one embodiment, the sheet 211 is fixed to the longitudinal support rod 12 by welding. In one embodiment, the sheet 211 is fixed to the longitudinal support rod 12 by bolts.

The support 21 is provided with a first limiting portion 212, and the limiting portion 212 abuts against the top portion of the longitudinal support rod 12 to achieve the positioning of the support 21 and the longitudinal support rod 12, thereby facilitating subsequent fixing. In the present embodiment, the first limiting portion 212 is formed by bending a side portion of the sheet 211 to enable the first limiting portion 212 to be protruded from the sheet 211 in the first direction X. The first limiting portion 212 has the advantage of a simple structure and convenience in processing.

Optionally, in the present embodiment, the elevation unit 2 may include an elevation portion connected to the support 21. In one embodiment, the elevation portion (the elevation unit 2) includes a first elevation rod 22, a second elevation rod 23, and a connecting piece 24. A first end of the first elevation rod 22 is hinged to the support 21, and a second end of the first elevation rod 22 is hinged to the connecting piece 24. A first end of the second elevation rod 23 is hinged to the support 21, and a second end of the second elevation rod 23 is hinged to the connecting piece 24. The hinge point position where the first elevation rod 22 is hinged to the support 21 is different from the hinge point position where the second elevation rod 23 is hinged to the support 21, and the hinge point position where the first elevation rod 22 is hinged to the connecting piece 24 is different from the hinge point position where the second elevation rod 23 is hinged to the connecting piece 24. Therefore, the elevation unit 2 has greater structural stability and higher structural strength and is more controllable in a movement manner when the connecting piece 24 moves relative to the first elevation rod 22 and the second elevation rod 23.

In the present embodiment, both the first elevation rod 22 and the second elevation rod 23 are sheet-shaped and extend along a plane.

In the present embodiment, the connecting piece 24 is a sheet-like structure and includes a first portion 241 and a second portion 242, and the first elevation rod 22 and the second elevation rod 23 are both hinged to the first portion 241 of the connecting piece 24. Optionally, the support 21 and the connecting piece 24 may be disposed on the same side of the first elevation rod 22: the support 21 and the connecting piece 24 may also be disposed on the same side of the second elevation rod 23: the support 21 and the connecting piece 24 may also be disposed on the same side of the first elevation rod 22 and the second elevation rod 23. Optionally, the vertical distance from the second portion 242 to the first elevation rod 22 may be greater than the vertical distance from the first portion 241 to the first elevation rod 22; the vertical distance from the second portion 242 to the second elevation rod 23 may also be greater than the vertical distance from the first portion 241 to the second elevation rod 23: the vertical distance from the second portion 242 to the first elevation rod 22 and the second elevation rod 23 may also be greater than the vertical distance from the first portion 241 to the first elevation rod 22 and the second elevation rod 23. In other words, the second portion 242 maintains a spacing from at least one of the first elevation rod 22 or the second elevation rod 23 in a thickness direction of the connecting piece 24, and the distance from the support 21 to the connecting piece 24 in the thickness direction of the connecting piece 24 is disposed within the spacing. Through the arrangement of the spacing, the support 21 can be prevented from affecting the motion of the connecting piece 24 during the motion.

In the present embodiment, the extension unit 3 includes a base plate 31, a lifting unit 32, a foot adjustment unit 33, and a backrest adjustment unit 34. The base plate 31 is fixed to the connecting piece 24 (that is, the extension unit 3 is fixed to the elevation unit 2 through the base plate 31). In the present embodiments, two sets of extension units 3 are provided, and the two sets of extension units 3 are disposed on both sides of the seat frame in the first direction X.

The lifting unit 32 is connected to the base plate 31. The lifting unit 32 includes a first lifting connecting rod 321, a second lifting connecting rod 322, a third lifting connecting rod 323, a fourth lifting connecting rod 324, and a seat surface mounting portion 325. A first end 3211 of the first lifting connecting rod 321 is hinged to the base plate 31, a second end 3212 of the first lifting connecting rod 321 is hinged to a first end 3231 of the third lifting connecting rod 323, a second end 3232 of the third lifting connecting rod 323 is hinged to a first end 3251 of the seat surface mounting portion 325, a second end 3252 of the seat surface mounting portion 325 is hinged to a first end 3241 of the fourth lifting connecting rod 324, a second end 3242 of the fourth lifting connecting rod 324 is hinged to a first end 3221 of the second lifting connecting rod 322, and a second end 3222 of the second lifting connecting rod 322 is connected to the base plate 31. In the present embodiment, the first lifting connecting rod 321, the second lifting connecting rod 322, the third lifting connecting rod 323, the fourth lifting connecting rod 324, and the seat surface mounting portion 325 are all sheet-shaped structures.

In one embodiment, the first lifting connecting rod 321 and the second lifting connecting rod 322 are hinged at a first rotating fulcrum 301, and the first rotating fulcrum 301 may be located in the middle region of at least one of the first lifting connecting rod 321 or the second lifting connecting rod 322. When the first lifting connecting rod 321 and the second lifting connecting rod 322 are rotated relative to the first rotating fulcrum 301, the relative positions of the first end 3211 of the first lifting connecting rod 321 and the first end 3221 of the second lifting connecting rod 322 can be lifted, thereby lifting the seat surface mounting portion 325. The structure described above is simpler and has higher structural stability than the lifting structure with multiple connecting rods.

In one embodiment, the second end 3222 of the second lifting connecting rod 322 is provided with a sliding slot 3223, the base plate 31 is provided with a corresponding hinge shaft 311, and the hinge shaft 311 is disposed in the sliding slot 3223. Therefore, the second end 3222 of the second lifting connecting rod 322 can be rotated relative to the base plate 31 and can be deflected relative to the base plate 31, thereby facilitating the design of the motion structure.

In the present embodiment, the base plate 31 is provided with a second limiting portion 312, and the second limiting portion 312 is disposed correspondingly to the first lifting connecting rod 321 to limit the sinking limit of the first lifting connecting rod 321.

In the present embodiment, the seat surface mounting portion 325 is provided with a third limiting portion 3253, and the third limiting portion 3253 is disposed correspondingly to the fourth lifting connecting rod 324 to limit the downward limit of the seat surface mounting portion 325.

In the present embodiment, the seat surface mounting portion 325 may further be provided with a mounting member 3254 for mounting the seat surface. The mounting member 3254 may be fixed directly to the seat surface mounting portion 325 by welding or may be fixed to the seat surface mounting portion 325 by bolts. In one embodiment, the mounting member 3254 and the seat surface mounting portion 325 are configured as a detachable structure, thereby providing more flexibility in the mounting position and structure configuration. The mounting member 3254 includes a first sheet portion 32541 and a second sheet portion 32542, the first sheet portion 32541 is mounted on the seat surface mounting portion 325 (by bolts), and the second sheet portion 32542 provides supporting and mounting functions and is provided with multiple mounting holes. The first sheet portion 32541 and the second sheet portion 32542 are integrally formed by bending.

In one embodiment, the configuration of the mounting member 3254 and the seat surface mounting portion 325 as a detachable structure means that the mounting member 3254 is detachably mounted on the seat surface mounting portion 325.

In the present embodiment, the fourth lifting connecting rod 324 is L-shaped or is substantially L-shaped to improve the structural strength and thus enhance the supporting capacity. Similarly, the third lifting connecting rod 323 may also be L-shaped or substantially L-shaped to improve the structural strength and thus enhance the supporting capacity.

In the present embodiment, the first lifting connecting rod 321 has a first bent portion 3213 to form a receiving space in a width direction of the seat frame (in the first direction X), and a part or all of the third lifting connecting rod 323 is located in the receiving space in the width direction of the seat frame. In the present embodiment, the first lifting connecting rod 321 has a second bent portion 3214, and the second bent portion 3214 forms a first end 3211 of the first lifting connecting rod 321, thereby more conveniently achieving the connection to the base plate 31.

In the present embodiment, the foot adjustment unit 33 is connected to the lifting unit 32 and includes a first foot adjustment rod 331, a second foot adjustment rod 332, a third foot adjustment rod 333, a fourth foot adjustment rod 334, and a foot mounting portion 335. The foot mounting portion 335 is configured to mount a foot support pedal thereon. A first end 3311 of the first foot adjustment rod 331 is hinged to the first end 3231 of the third lifting connecting rod 323, a second end 3312 of the first foot adjustment rod 331 is hinged to a first end 3321 of the second foot adjustment rod 332, and a second end 3322 of the second foot adjustment rod 332 is hinged to the foot mounting portion 335. A first end 3331 of the third foot adjustment rod 333 is hinged to the first end 3251 of the seat surface mounting portion 325, a second end 3332 of the third foot adjustment rod 333 is hinged to a first end 3341 of the fourth foot adjustment rod 334, and a second end 3342 of the fourth foot adjustment rod 334 is hinged to the foot mounting portion 335.

In the present embodiment, the second foot adjustment rod 332 and the third foot adjustment rod 333 are hinged at a second rotating fulcrum 3201, and the second rotating fulcrum 3201 is located in the middle region of at least one of the second foot adjustment rod 332 or the third foot adjustment rod 333. In the present embodiment, the middle region of the second foot adjustment rod 332 refers to the region between the first end 3321 and the second end 3322 of the second foot adjustment rod 332, and the middle region of the third foot adjustment rod 333 refers to the region between the first end 3331 and the second end 3332 of the third foot adjustment rod 333. The second foot adjustment rod 332 and the third foot adjustment rod 333 are rotated through the second rotating fulcrum 3201 so that the foot adjustment unit 33 is stretched or collapsed to achieve the adjustment, and such a structure is simple.

In one embodiment, the foot adjustment unit 33 may include a fifth foot adjustment rod 336. A first end of the fifth foot adjustment rod 336 is hinged to the middle region (the middle region here refers to the region between the first end 3311 and the second end 3312 of the first foot adjustment rod 331) of the first foot adjustment rod 331, and a second end of the fifth foot adjustment rod 336 is hinged to the middle region (the middle region here refers to the region between the first end 3331 and the second end 3332 of the third foot adjustment rod 333) of the third foot adjustment rod 333. By setting the fifth foot adjustment rod 336, in one aspect, the first foot adjustment rod 331 and the third foot adjustment rod 333 can be mutually supported through the fifth foot adjustment rod 336, and in another aspect, the stability of the structure can be improved.

In the present embodiment, the third foot adjustment rod 333 is provided with a fourth limiting portion 3333, and the fourth limiting portion 3333 is disposed correspondingly to the second foot adjustment rod 332 to limit the collapse limit of the foot adjustment unit 33.

In the present embodiment, the backrest adjustment unit 34 is connected to the lifting unit 32 and is used for mounting a backrest thereon. Optionally, the backrest adjustment unit 34 includes a backrest adjustment rod 341 and a backrest mounting portion 342, and the backrest mounting portion 342 is used for mounting a backrest thereon. A first end 3411 of the backrest adjustment rod 341 is hinged to the base plate 31, and a second end 3412 of the backrest adjustment rod 341 is hinged to the backrest mounting portion 342. The backrest mounting portion 342 is hinged to the second end 3252 of the seat surface mounting portion 325. Through the motion of the seat surface mounting portion 325, the backrest mounting portion 342 can be driven to be rotated and adjusted. By setting the backrest adjustment rod 341, in one aspect, the backrest mounting portion 342 can be adjusted, and in another aspect, the backrest mounting portion 342 can be supported.

In the present embodiment, the second end 3252 of the seat surface mounting portion 325 is provided with a turning portion 3255. The turning portion 3255 is disposed at an included angle (the included angle is about 70 to 120 degrees) with the main body portion of the seat surface mounting portion 325, and the backrest mounting portion 342 is hinged to the turning portion 3255. In use, the turning portion 3255 can provide a supporting function, and thus the turning portion 3255 is disposed at an included angle from the main body portion of the seat surface mounting portion 325, thereby improving the structural stability and structural strength and improving the supporting capacity.

In the present embodiment, the backrest adjustment rod 341 is concave on the outer side of the seat frame in the second direction Y, thereby improving the structural strength of the backrest adjustment rod 341. The concave structure can also provide an avoiding function (to avoid the wooden frame cross rod disposed on the seat frame) or a positioning function. In the present embodiment, the backrest adjustment rod 341 includes a main body portion 3413, and the first end 3411 and the second end 3412 of the backrest adjustment rod 341 are separately located at both ends of the main body portion 3413. The main body portion 3413 is disposed at an obtuse angle with the first end 3411, and the main body portion 3413 is disposed at an obtuse angle with the second end 3412. That is, the first end 3411 and the second end 3412 are each bent with respect to the main body portion 3413. Through the structure of the backrest adjustment rod 341, when the backrest adjustment rod 341 bears weight, the borne weight is prevented from being concentrated, thereby improving the bearing capacity.

In the present embodiment, as a separate component, the extension unit 3 can achieve the stretch and collapse of the foot adjustment unit 33, the angle adjustment of the backrest adjustment unit 34, and the lifting or lowering of the lifting unit 32, thereby achieving the switch among the sitting posture, the TV posture, and the lying posture. Such a structure is simple with high structural stability.

In the present embodiment, the power unit 4 is disposed on the base 1 and separately connected to the elevation unit 2 and the extension unit 3. The power unit 4 can control the lifting and lowering of the elevation unit 2 and the motion of the extension unit 3.

In one embodiment, the power unit 4 includes a drive unit 41, a connecting base 42, and a drive connecting rod 43. The drive unit 41 may be retractable, and a cylinder structure, an oil rod structure or a motor structure in the related art may be adopted to achieve the retractable function. In the present embodiment, the drive unit 41 is driven by a motor to achieve its stretch and retraction, thereby adjusting the state of the seat frame. A first end of the drive unit 41 is hinged to the base 1. Optionally, a first hinge base 44 is fixed to one set of transverse support rod 11 of the base 1, and the first end of the drive unit 41 is hinged to the first hinge base 44. A second end of the drive unit 41 is hinged to the connecting base 42. Optionally, a second hinge base 45 is fixed to the drive connecting rod 43, and the second end of the drive unit 41 is hinged to the second hinge base 44.

In the present embodiment, one end of the drive connecting rod 43 is directly hinged to the connecting piece 24, and when the drive unit 41 is actuated, the connecting piece 24 can be lifted or lowered through the drive connecting rod 43.

In the present embodiment, the drive connecting rod 43 may be directly connected to the seat surface mounting portion 325. The drive connecting rod 43 may also be indirectly connected to the seat surface mounting portion 325. In one embodiment, the power unit 4 further includes a first drive rod 46 and a second drive rod 47. A first end of the first drive rod 46 is hinged to the drive connecting rod 43, a second end of the first drive rod 46 is hinged to a first end of the second drive rod 47, and a second end of the second drive rod 47 is hinged to the seat surface mounting portion 325. When the drive unit 41 is actuated, the extension unit 3 can be actuated by driving the seat surface mounting portion 325.

In the present embodiment, the seat frame can be adjusted among four states through one power unit, making the structure simple and reducing the cost.

In the present embodiment, the seat frame has various states to provide different use postures.

For example, the seat frame has a sitting posture state (in which the seat can be used as a normal seat), a TV posture state (in which the seat is reclined to be suitable for watching TV), a lying posture state (in which the backrest is more reclined compared with the TV posture state and the seat presents a lying posture), and a standing posture state (in which the seat is lifted compared with the sitting posture state and can assist a user to stand up).

As shown in FIG. 1, the seat frame is in a standing posture state, the seat frame assists a user (especially the elderly) to stand up in this state, and the elevation unit 2 is lifted to a high position or the highest position at this point. The foot adjustment unit 33 is collapsed relative to the lifting unit 32. The lifting unit 32 is lowered. The angle of the backrest adjustment unit 34 relative to the seat surface mounting portion 325 is a1. The length size of the drive unit 41 is L1.

Figure 5:
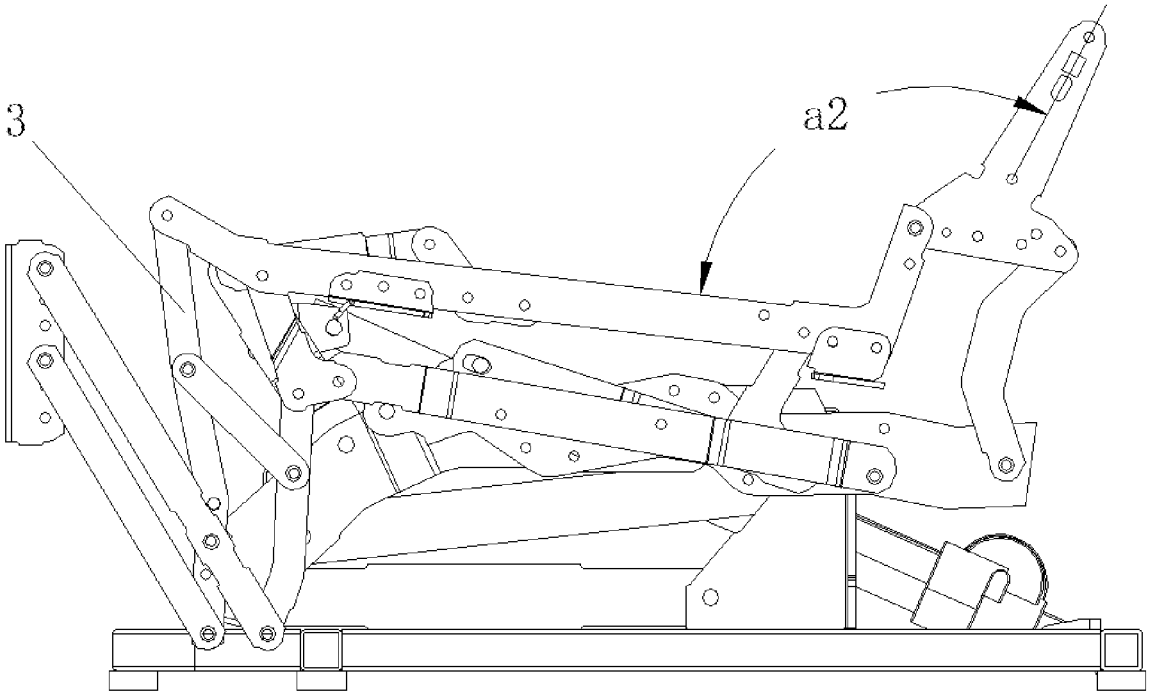
FIG. 5 is a front view of the seat frame in Embodiment 1 of the present application, with the seat frame in a sitting posture state.
Figure 6:
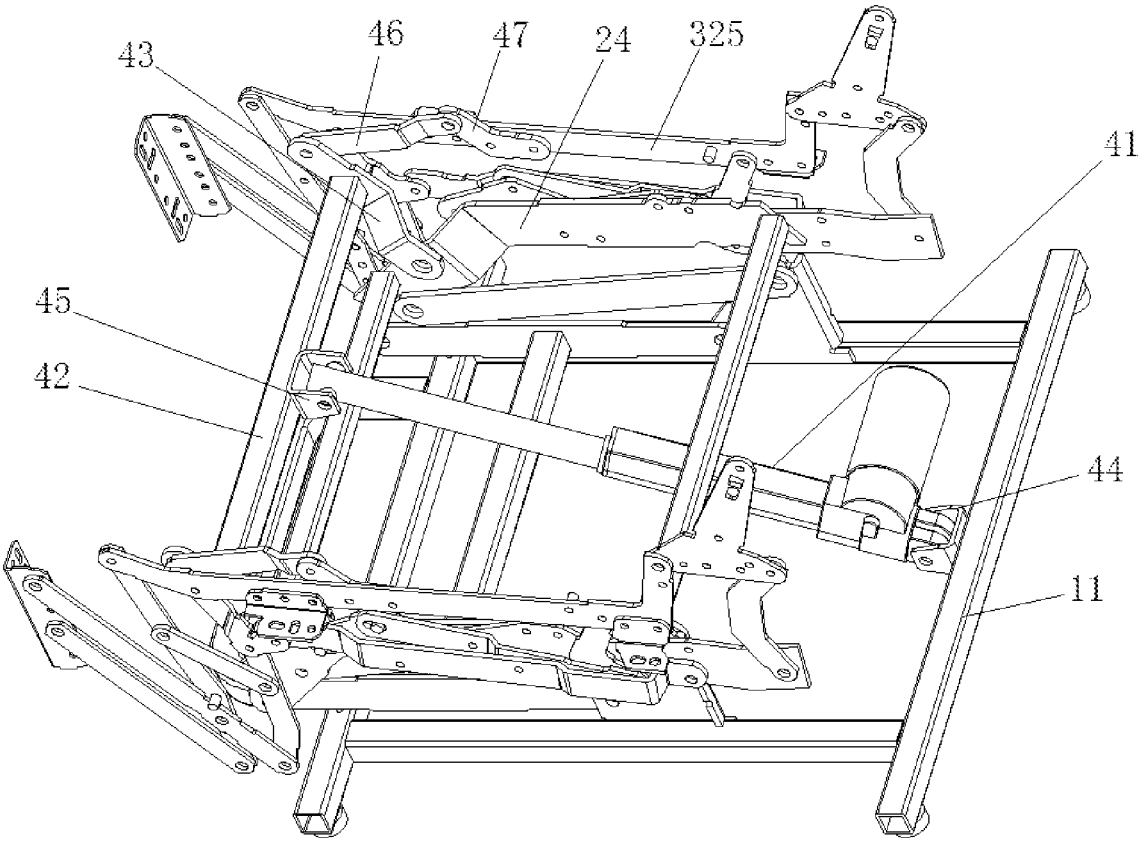
FIG. 6 is a perspective view of the seat frame in Embodiment 1 of the present application, with the seat frame in a sitting posture state.

As shown in FIG. 5, the seat frame is in a sitting posture state, and the elevation unit 2 is lowered to the lowest position at this point. The first elevation rod 22 of the elevation unit 2 is supported on the transverse support rod 11. The first lifting connecting rod 321 is supported on the second limiting portion 312 of the base plate 31, and the foot adjustment unit 33 is collapsed relative to the lifting unit 32. The lifting unit 32 is lowered. The angle of the backrest adjustment unit 34 relative to the seat surface mounting portion 325 is a2 (a1 is equal to or substantially equal to a2). The length size of the drive unit 41 is L2 (L2 is less than L1).

Figure 7:
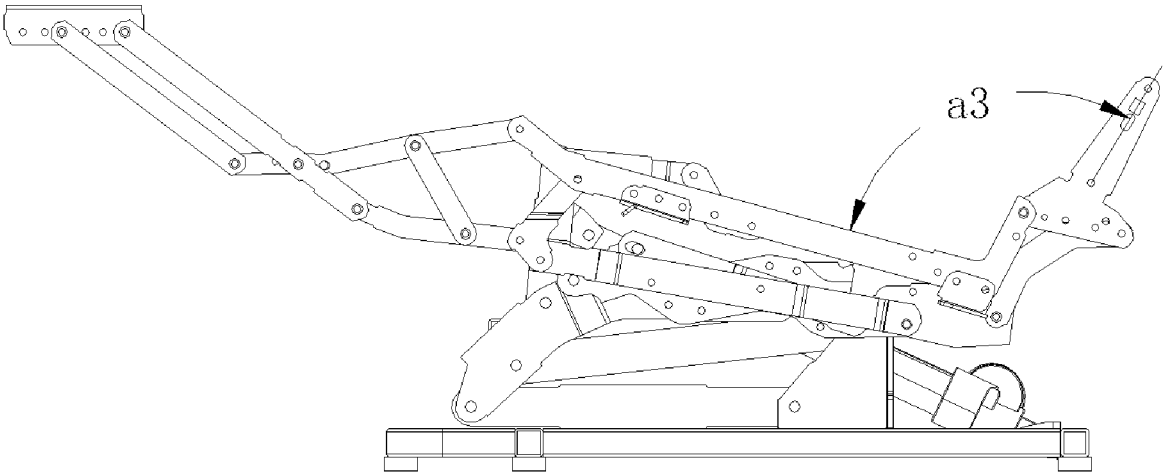
FIG. 7 is a front view of the seat frame in Embodiment 1 of the present application, with the seat frame in a TV posture state.
Figure 8:
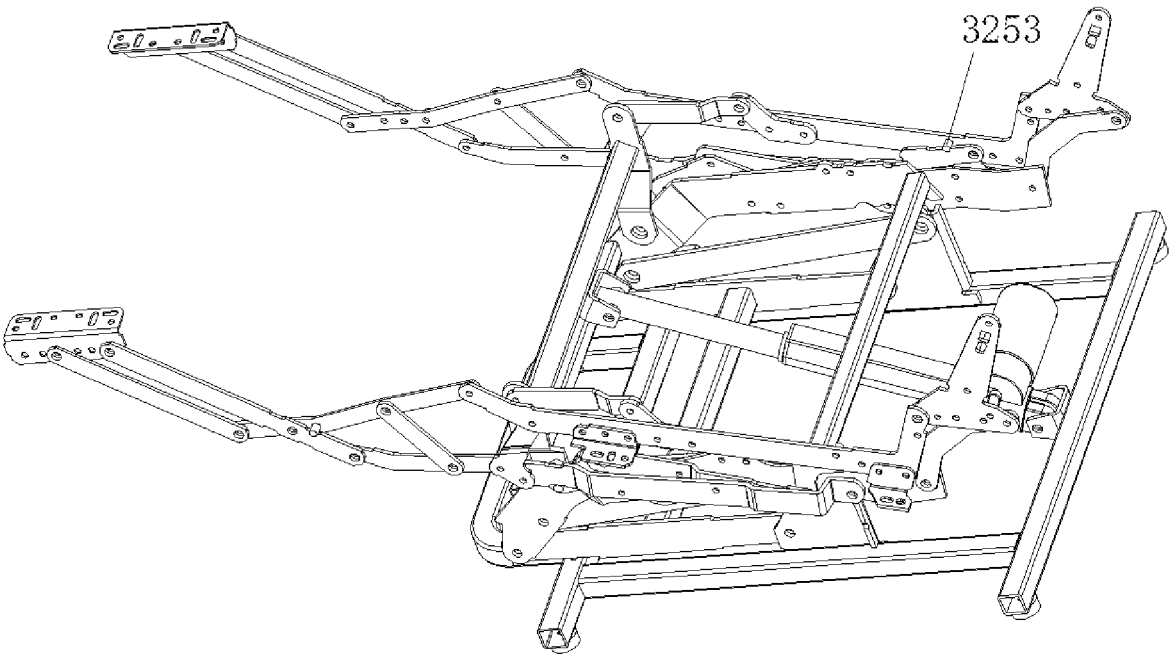
FIG. 8 is a perspective view of the seat frame in Embodiment 1 of the present application, with the seat frame in a TV posture state.

As shown in FIG. 7, the seat frame is in a TV posture state, and the elevation unit 2 is lowered to a low position at this point. The first elevation rod 22 of the elevation unit 2 is supported on the transverse support rod 11. The foot adjustment unit 33 is stretched relative to the lifting unit 32. The lifting unit 32 is lowered. The angle of the backrest adjustment unit 34 relative to the seat surface mounting portion 325 is a3 (a3 is greater than a2, that is, the backrest adjustment unit 34 is stretched more greatly in the TV posture state than in the sitting posture state). The length size of the drive unit 41 is L3 (L3 is less than L2).

Figure 9:
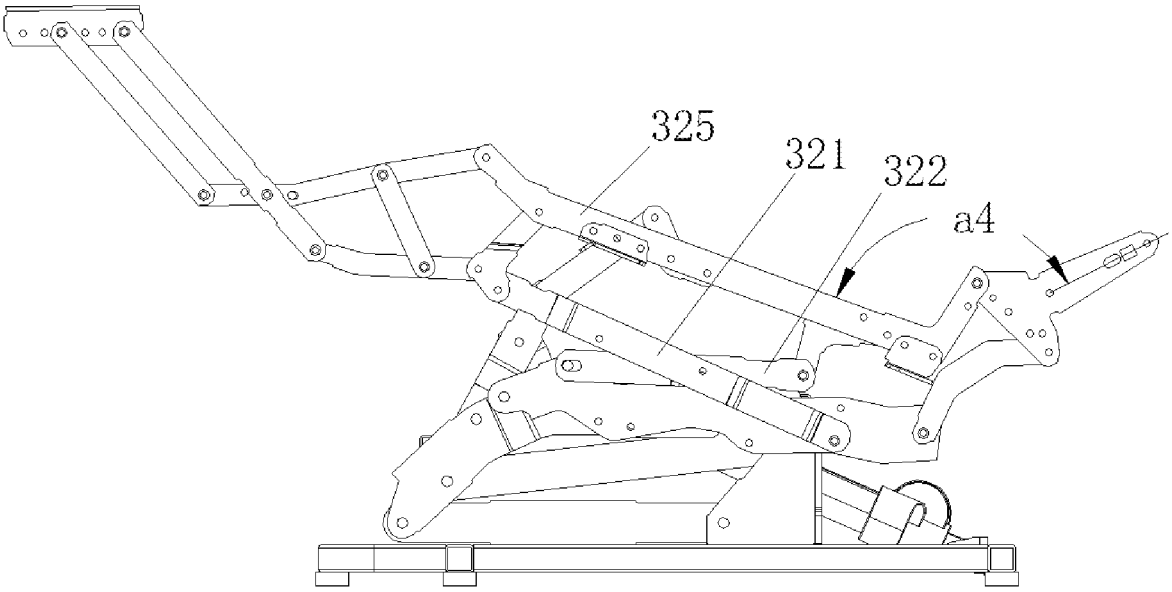
FIG. 9 is a front view of the seat frame in Embodiment 1 of the present application, with the seat frame in a lying posture state.
Figure 10:
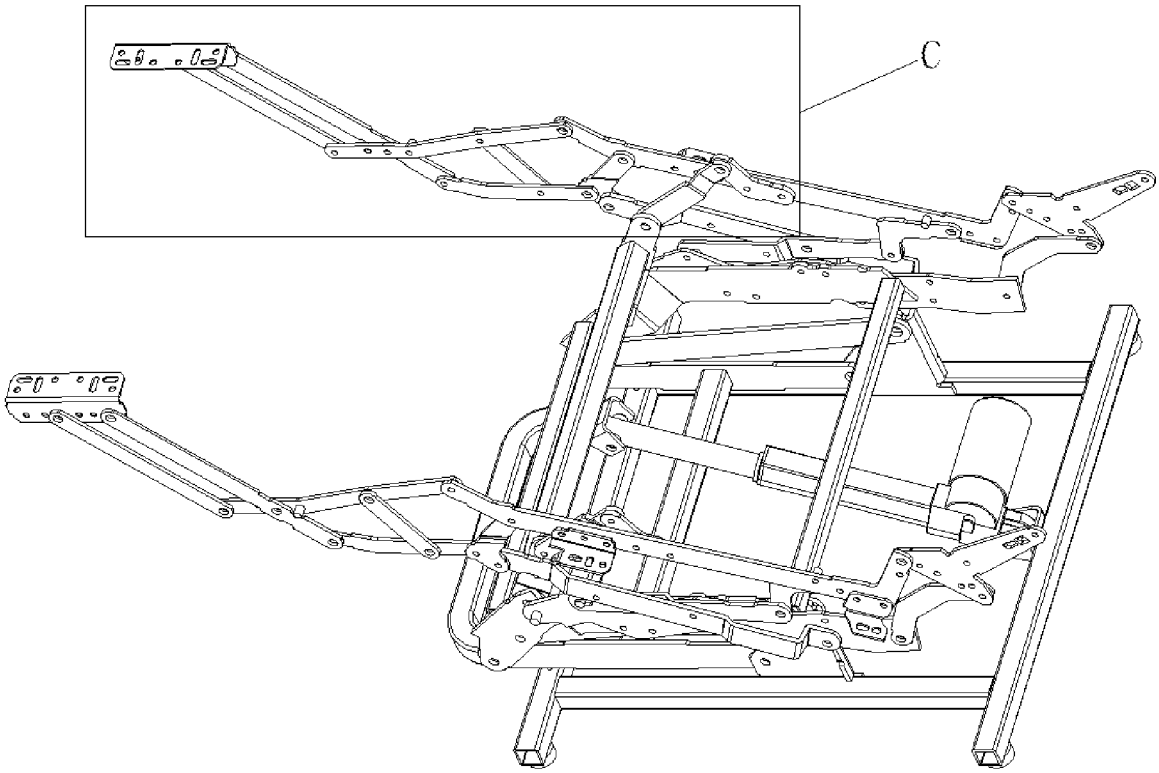
FIG. 10 is a perspective view of the seat frame in Embodiment 1 of the present application, with the seat frame in a lying posture state.
Figure 11:
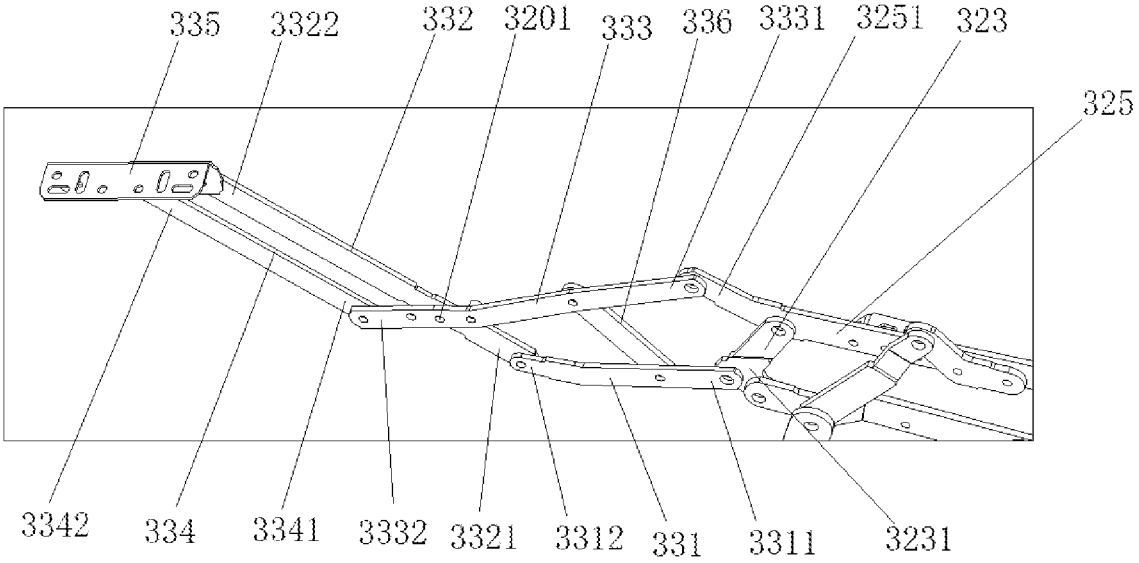
FIG. 11 is an enlarged view of the portion at C in FIG. 10.
Figure 12:
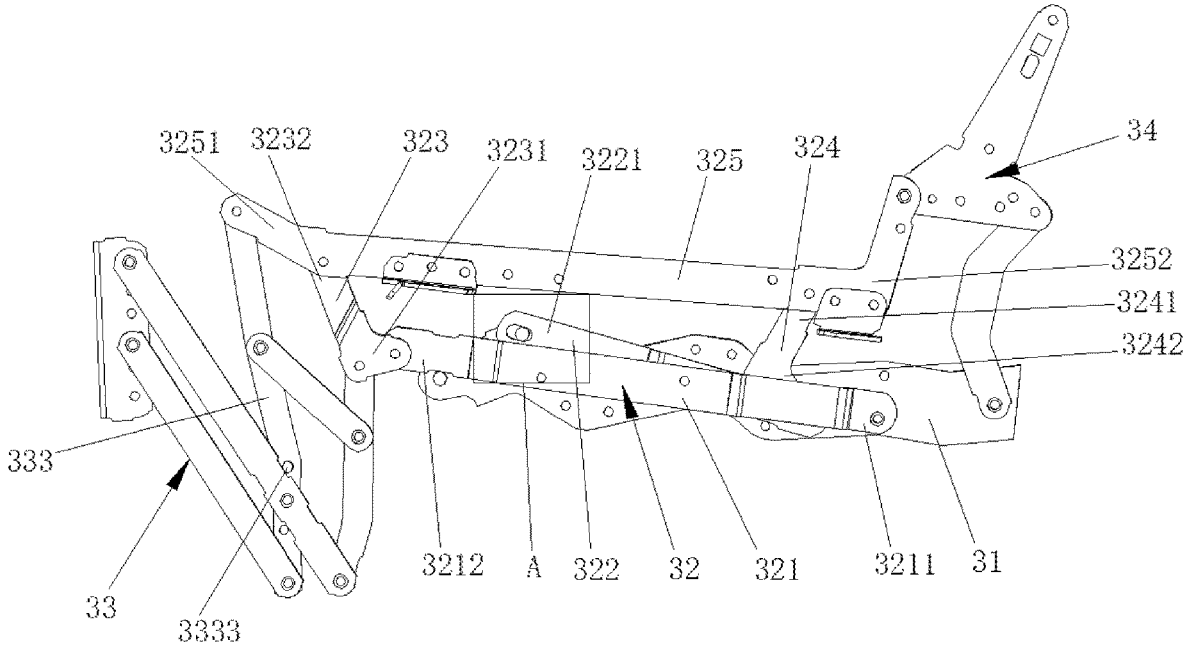
FIG. 12 is a perspective view one of an extension unit.
Figure 13:
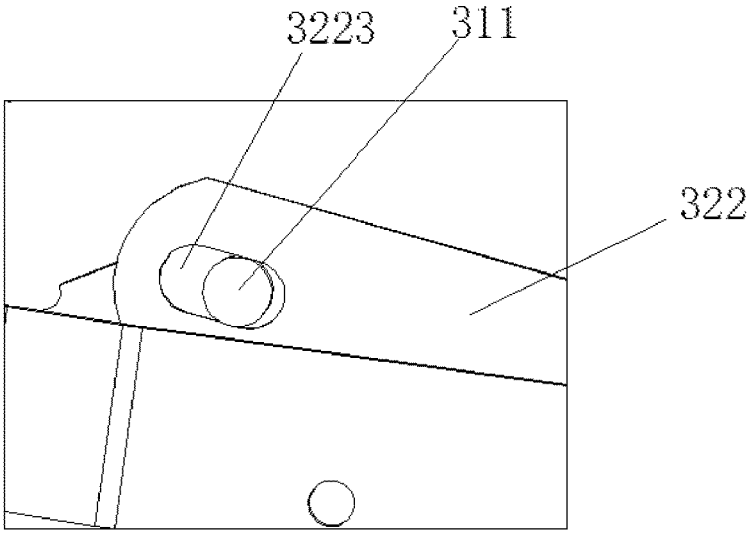
FIG. 13 is an enlarged view of the portion at A in FIG. 12.
Figure 14:
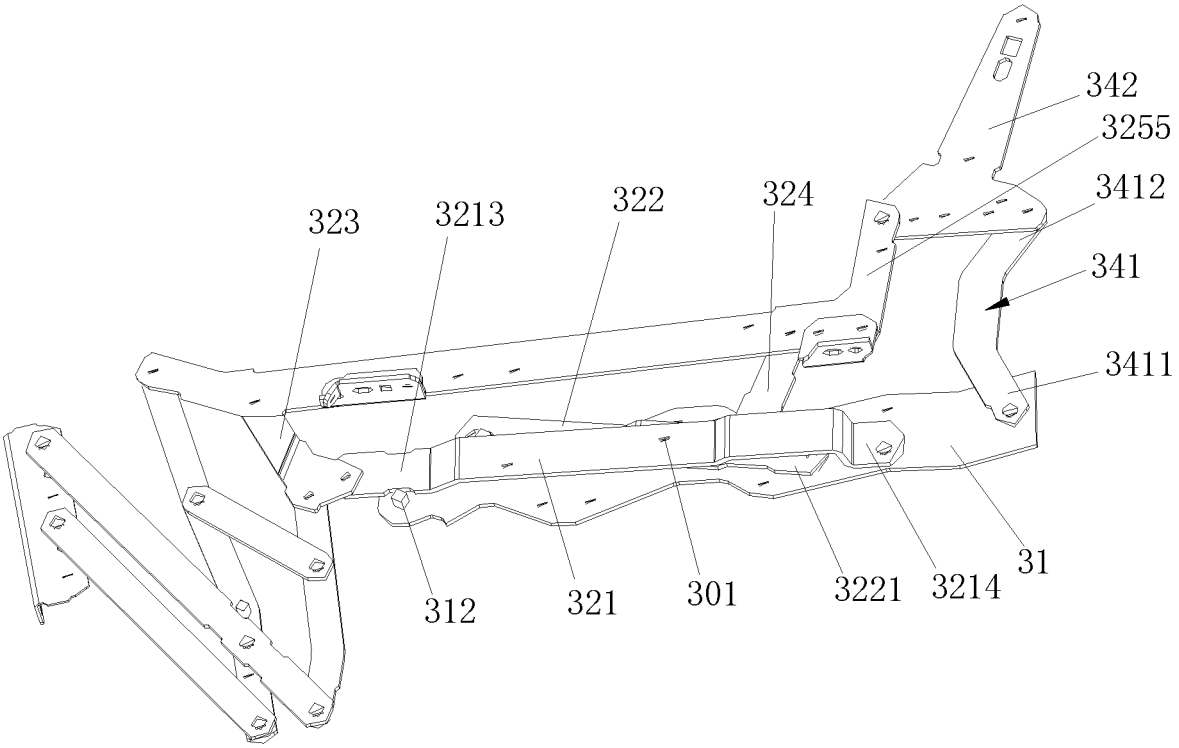
FIG. 14 is a perspective view two of an extension unit.
Figure 15:
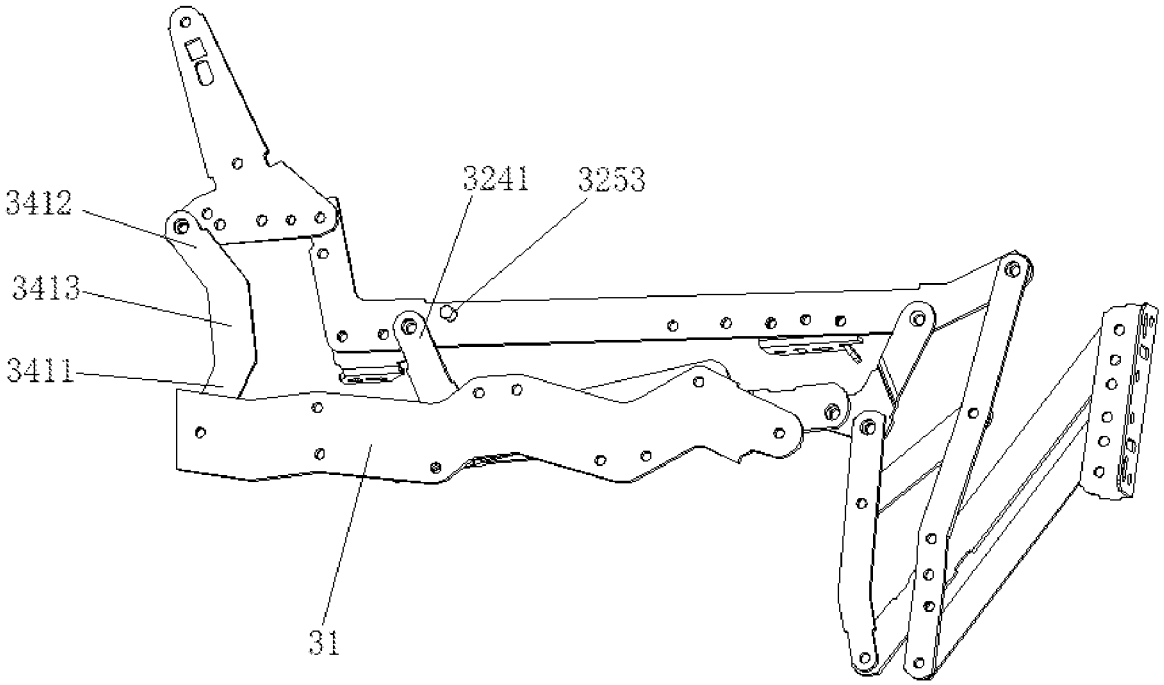
FIG. 15 is a perspective view three of an extension unit.
Figure 16:
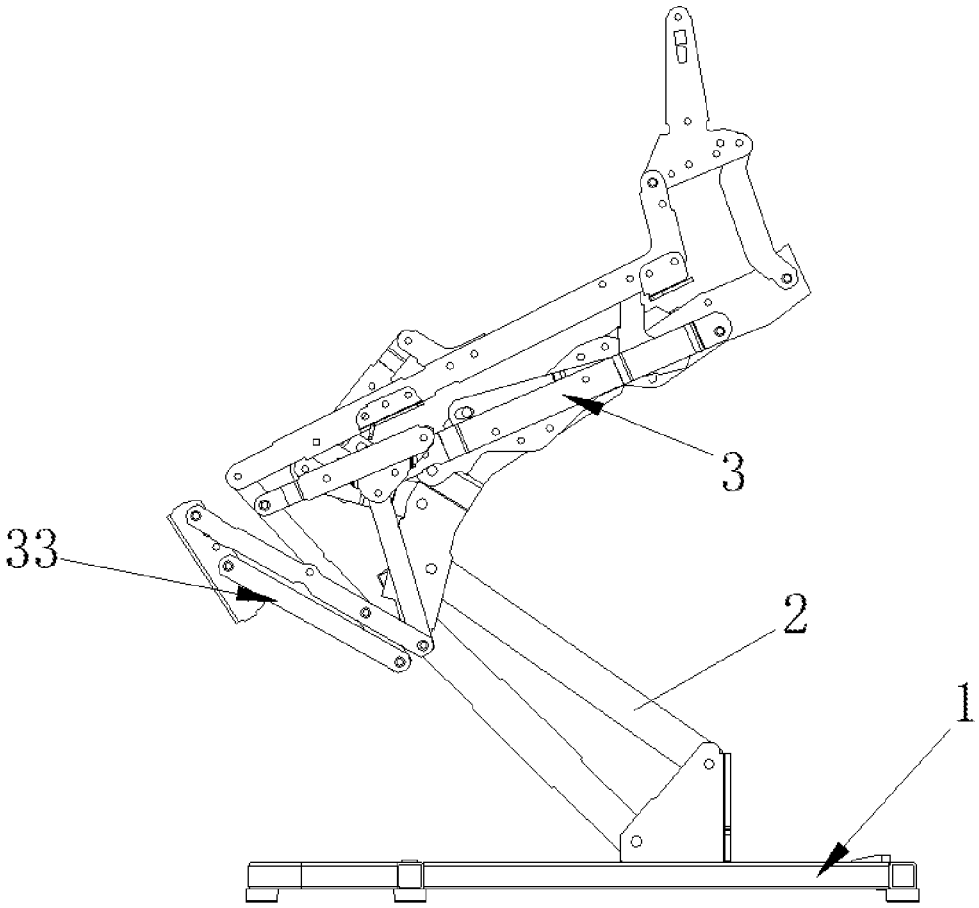
FIG. 16 is a front view of a seat frame in Embodiment 2, with the seat frame in a standing posture state.
Figure 17:
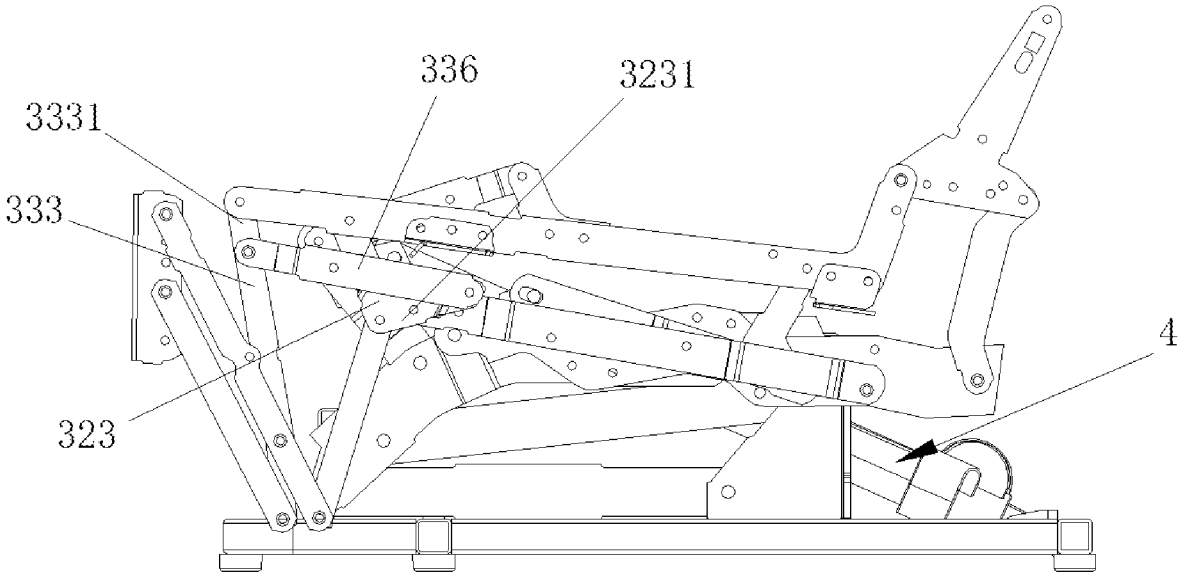
FIG. 17 is a front view of the seat frame in Embodiment 2, with the seat frame in a sitting posture state.
Figure 18:
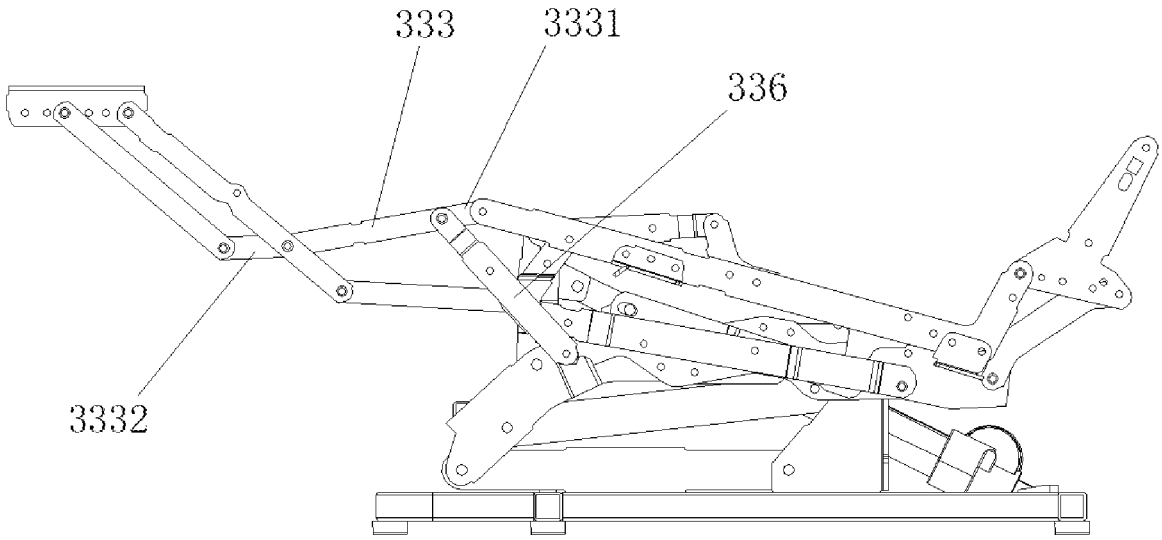
FIG. 18 is a front view of the seat frame in Embodiment 2, with the seat frame in a TV posture state.
Figure 19:
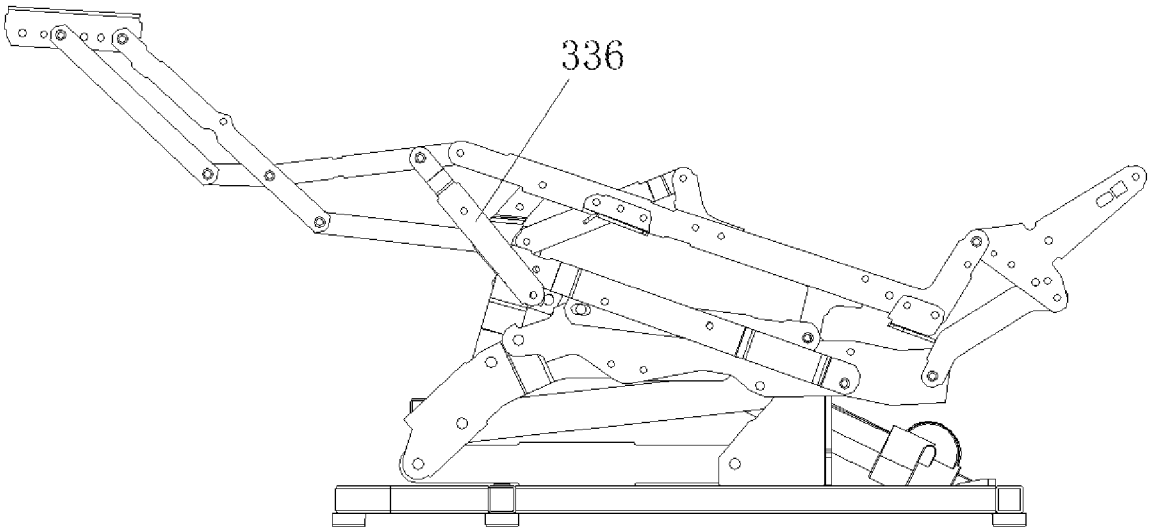
FIG. 19 is a front view of the seat frame in Embodiment 2, with the seat frame in a lying posture state.

As shown in FIG. 9, the seat frame is in a lying posture state, and the elevation unit 2 is lowered to a low position at this point. The first elevation rod 22 of the elevation unit 2 is supported on the transverse support rod 11. The foot adjustment unit 33 is stretched relative to the lifting unit 32. The lifting unit 32 is lifted, and the foot adjustment unit 33 is correspondingly lifted, generating a function similar to zero gravity. The angle of the backrest adjustment unit 34 relative to the seat surface mounting portion 325 is a4 (a4 is greater than a3, that is, the backrest adjustment unit 34 is stretched more greatly in the lying posture state than in the TV posture state). The length size of the drive unit 41 is L4 (L4 is less than L1).

When the drive unit 41 is in the stretched state, the seat frame is in the standing posture state, and during the gradual retraction of the drive unit 41, the seat frame is sequentially switched to the sitting posture state, the TV posture state, and the lying posture state. The elevation unit 2 is lifted only in the standing posture state and remains stationary in other states.

Compared with the related art, the structure is simpler and the design is more reasonable in the present application: the seat frame can be adjusted among four states using only one power unit, reducing the cost: the second anti-tipping portion is U-shaped and is fixed to one set of transverse support rod to form a closed structure with the transverse support rod so that the structure of the second anti-tipping portion is more stable and can bear more weight: when the first lifting connecting rod and the second lifting connecting rod are rotated relative to the first rotating fulcrum, the relative positions of the first end of the first lifting connecting rod and the first end of the second lifting connecting rod can be lifted, the seat surface mounting portion is thus lifted, and such a structure is simpler and has higher structural stability than the lifting structure with multiple connecting rods: the second end of the second lifting connecting rod is provided with a sliding slot, the base plate is provided with a corresponding hinge shaft, the hinge shaft is disposed in the sliding slot, and thus the second end of the second lifting connecting rod can be rotated relative to the base plate and can be deflected relative to the base plate, thereby facilitating the design of the motion structure: through the structure of the backrest adjustment rod, when the backrest adjustment rod bears weight, the borne weight is prevented from being concentrated, thereby improving the bearing capacity, and in addition, the wooden frame cross rod disposed on the seat frame can be avoided: the limiting portion abuts against the top portion of the longitudinal support rod of the base when being mounted to achieve the positioning of the support and the longitudinal support rod, thereby facilitating subsequent fixing.

Embodiment 2

Referring to FIGS. 16 to 19, the seat frame in the present embodiment is suitable for an elderly seat and includes a base 1, a lifting unit 2, an extension unit 3, and a power unit 4. The basic mechanisms of the seat frame in the present embodiment are the same as those of the seat frame described in Embodiment 1. The difference is that the first end of the fifth foot adjustment rod 336 of the foot adjustment unit 33 is hinged to the first end 3231 of the third lifting connecting rod 323, and the second end of the fifth foot adjustment rod 336 is hinged to the middle region of the third foot adjustment rod 333 (the middle region here refers to the region between the first end 3331 and the second end 3332 of the third foot adjustment rod 333).

Embodiment 3

An elderly seat in the present embodiment includes a seat frame described in Embodiment 1 or 2.

What is claimed:

1. A seat frame, comprising:

a base, comprising a transverse support rod and a longitudinal support rod, wherein the transverse support rod extends in a first direction, the longitudinal support rod extends in a second direction that is different from the first direction, and the transverse support rod is connected to the longitudinal support rod;

an elevation unit, comprising a support, a first elevation rod, a second elevation rod that is different from the first elevation rod, and a connecting piece, wherein a first end of the first elevation rod is hinged to the support, and a second end of the first elevation rod is hinged to the connecting piece; a first end of the second elevation rod is hinged to the support, and a second end of the second elevation rod is hinged to the connecting piece; a hinge point position where the first elevation rod is hinged to the support is different from a hinge point position where the second elevation rod is hinged to the support, a hinge point position where the first elevation rod is hinged to the connecting piece is different from a hinge point position where the second elevation rod is hinged to the connecting piece, the hinge point position where the first elevation rod is hinged to the support is different from the hinge point position where the first elevation rod is hinged to the connecting piece, and the hinge point position where the second elevation rod is hinged to the support is different from the hinge point position where the second elevation rod is hinged to the connecting piece;

an extension unit, comprising a base plate, a lifting unit, a foot adjustment unit, and a backrest adjustment unit, wherein the base plate is fixed to the connecting piece; and a power unit, disposed on the base and separately connected to the elevation unit and the extension unit, wherein the power unit comprises a drive unit, a connecting base, and a drive connecting rod, a first end of the drive unit is hinged to the base, and a second end of the drive unit is hinged to the connecting base;

wherein the lifting unit comprises a first lifting connecting rod, a second lifting connecting rod, a third lifting connecting rod, a fourth lifting connecting rod, and a seat surface mounting portion; the first lifting connecting rod, the second lifting connecting rod, the third lifting connecting rod, and the fourth lifting connecting rod are different from each other, a first end of the first lifting connecting rod is hinged to the base plate, a second end of the first lifting connecting rod is hinged to a first end of the third lifting connecting rod, a second end of the third lifting connecting rod is hinged to a first end of the seat surface mounting portion, a second end of the seat surface mounting portion is hinged to a first end of the fourth lifting connecting rod, a second end of the fourth lifting connecting rod is hinged to a first end of the second lifting connecting rod, and a second end of the second lifting connecting rod is connected to the base plate; the first lifting connecting rod and the second lifting connecting rod are hinged at a first rotating fulcrum, and the first rotating fulcrum is located in a middle region of at least one of the first lifting connecting rod or the second lifting connecting rod.

2. The seat frame according to claim 1, wherein the second end of the second lifting connecting rod is provided with a sliding slot, the base plate is provided with a corresponding hinge shaft, and the hinge shaft is disposed in the sliding slot.

3. The seat frame according to claim 1, wherein the foot adjustment unit comprises a first foot adjustment rod, a second foot adjustment rod, a third foot adjustment rod, a fourth foot adjustment rod, and a foot mounting portion, wherein the first foot adjustment rod, the second foot adjustment rod, the third foot adjustment rod, and the fourth foot adjustment rod are different from each other, a first end of the first foot adjustment rod is hinged to the first end of the third lifting connecting rod, a second end of the first foot adjustment rod is hinged to a first end of the second foot adjustment rod, a second end of the second foot adjustment rod is hinged to the foot mounting portion, a first end of the third foot adjustment rod is hinged to the first end of the seat surface mounting portion, a second end of the third foot adjustment rod is hinged to a first end of the fourth foot adjustment rod, and a second end of the fourth foot adjustment rod is hinged to the foot mounting portion.

4. The seat frame according to claim 3, wherein the foot adjustment unit further comprises a fifth foot adjustment rod, a first end of the fifth foot adjustment rod is hinged to a middle region of the first foot adjustment rod, and a second end of the fifth foot adjustment rod is hinged to a middle region of the third foot adjustment rod.

5. The seat frame according to claim 3, wherein the second foot adjustment rod and the third foot adjustment rod are hinged at a second rotating fulcrum that is different from the first rotating fulcrum, and the second rotating fulcrum is located in a middle region of at least one of the second foot adjustment rod or the third foot adjustment rod.

6. The seat frame according to claim 3, wherein the foot adjustment unit further comprises a fifth foot adjustment rod, a first end of the fifth foot adjustment rod is hinged to the first end of the third lifting connecting rod, and a second end of the fifth foot adjustment rod is hinged to a middle region of the third foot adjustment rod, wherein the first foot adjustment rod, the second foot adjustment rod, the third foot adjustment rod, the fourth foot adjustment rod, and the fifth foot adjustment rod are different from each other.

7. The seat frame according to claim 1, wherein the backrest adjustment unit comprises a backrest adjustment rod and a backrest mounting portion, wherein a first end of the backrest adjustment rod is hinged to the base plate, a second end of the backrest adjustment rod is hinged to the backrest mounting portion, and the backrest mounting portion is hinged to the second end of the seat surface mounting portion.

8. The seat frame according to claim 7, wherein the second end of the seat surface mounting portion is provided with a turning portion, the turning portion is disposed at an included angle from the main body portion of the seat surface mounting portion, the included angle is 70 to 120 degrees, and the backrest mounting portion is hinged to the turning portion.

9. The seat frame according to claim 7, wherein the backrest adjustment rod comprises a main body portion, the first end of the backrest adjustment rod and the second end of the backrest adjustment rod are separately located at both ends of the main body portion, and the first end of the backrest adjustment rod and the second end of the backrest adjustment rod are each bent with respect to the main body portion.

10. The seat frame according to claim 1, wherein the power unit further comprises a first drive rod and a second drive rod that is different from the first drive rod, a first end of the first drive rod is hinged to the drive connecting rod, a second end of the first drive rod is hinged to a first end of the second drive rod, and a second end of the second drive rod is hinged to the seat surface mounting portion.

11. The seat frame according to claim 1, wherein the base is provided with a first anti-tipping portion and a second anti-tipping portion that is different from the first anti-tipping portion, and one end or both ends of the transverse support rod extends beyond the longitudinal support rod to form the first anti-tipping portion; the second anti-tipping portion is protruded from the base in the second direction, the second anti-tipping portion is U-shaped, and a ratio of a width dimension of the second anti-tipping portion in the second direction to a width dimension of a support frame of the base is 1:3.5 to 1:4.5.

12. The seat frame according to claim 1, wherein the first lifting connecting rod has a first bent portion to form a receiving space in a width direction of the seat frame, and a part or all of the third lifting connecting rod is located in the receiving space in the width direction of the seat frame.

13. The seat frame according to claim 1, wherein the seat surface mounting portion is provided with a mounting member which is detachable from the seat surface mounting portion, the mounting member comprises a first sheet portion and a second sheet portion that is different from the first sheet portion, the first sheet portion is mounted on the seat surface mounting portion, and the second sheet portion is provided with a plurality of mounting holes.

14. An extension unit of a seat frame, comprising:

a base plate;

a lifting unit connected to the base plate;

a foot adjustment unit connected to the lifting unit; and a backrest adjustment unit connected to the lifting unit;

wherein the lifting unit comprises a first lifting connecting rod, a second lifting connecting rod, a third lifting connecting rod, a fourth lifting connecting rod, and a seat surface mounting portion; the first lifting connecting rod, the second lifting connecting rod, the third lifting connecting rod, and the fourth lifting connecting rod are different from each other, a first end of the first lifting connecting rod is hinged to the base plate, a second end of the first lifting connecting rod is hinged to a first end of the third lifting connecting rod, a second end of the third lifting connecting rod is hinged to a first end of the seat surface mounting portion, a second end of the seat surface mounting portion is hinged to a first end of the fourth lifting connecting rod, a second end of the fourth lifting connecting rod is hinged to a first end of the second lifting connecting rod, and a second end of the second lifting connecting rod is connected to the base plate; the first lifting connecting rod and the second lifting connecting rod are hinged at a first rotating fulcrum, and the first rotating fulcrum is located in a middle region of at least one of the first lifting connecting rod or the second lifting connecting rod.

15. The extension unit of a seat frame according to claim 14, wherein the backrest adjustment unit comprises a backrest adjustment rod and a backrest mounting portion, wherein a first end of the backrest adjustment rod is hinged to the base plate, a second end of the backrest adjustment rod is hinged to the backrest mounting portion, and the backrest mounting portion is hinged to the second end of the seat surface mounting portion;

wherein the backrest adjustment rod comprises a main body portion, the first end of the backrest adjustment rod and the second end of the backrest adjustment rod are separately located at both ends of the main body portion, and the first end of the backrest adjustment rod and the second end of the backrest adjustment rod are each bent with respect to the main body portion.

16. The extension unit of a seat frame according to claim 15, wherein the first lifting connecting rod has a first bent portion to form a receiving space in a width direction of the seat frame, and a part or all of the third lifting connecting rod is located in the receiving space in the width direction of the seat frame.

17. The extension unit of a seat frame according to claim 14, wherein the second end of the second lifting connecting rod is provided with a sliding slot, the base plate is provided with a corresponding hinge shaft, and the hinge shaft is disposed in the sliding slot.

18. The extension unit of a seat frame according to claim 14, wherein the foot adjustment unit comprises a first foot adjustment rod, a second foot adjustment rod, a third foot adjustment rod, a fourth foot adjustment rod, and a foot mounting portion, wherein the first foot adjustment rod, the second foot adjustment rod, the third foot adjustment rod, and the fourth foot adjustment rod are different from each other, a first end of the first foot adjustment rod is hinged to the first end of the third lifting connecting rod, a second end of the first foot adjustment rod is hinged to a first end of the second foot adjustment rod, a second end of the second foot adjustment rod is hinged to the foot mounting portion, a first end of the third foot adjustment rod is hinged to the first end of the seat surface mounting portion, a second end of the third foot adjustment rod is hinged to a first end of the fourth foot adjustment rod, and a second end of the fourth foot adjustment rod is hinged to the foot mounting portion;

wherein the second foot adjustment rod and the third foot adjustment rod are hinged at a second rotating fulcrum that is different from the first rotating fulcrum, and the second rotating fulcrum is located in a middle region of at least one of the second foot adjustment rod or the third foot adjustment rod;

wherein the foot adjustment unit further comprises a fifth foot adjustment rod, a first end of the fifth foot adjustment rod is hinged to the first end of the third lifting connecting rod, and a second end of the fifth foot adjustment rod is hinged to a middle region of the third foot adjustment rod, wherein the first foot adjustment rod, the second foot adjustment rod, the third foot adjustment rod, the fourth foot adjustment rod, and the fifth foot adjustment rod are different from each other;

wherein the foot adjustment unit further comprises a fifth foot adjustment rod, a first end of the fifth foot adjustment rod is hinged to a middle region of the first foot adjustment rod, and a second end of the fifth foot adjustment rod is hinged to a middle region of the third foot adjustment rod.

19. The extension unit of a seat frame according to claim 14, wherein the base plate is provided with a second limiting portion, and the second limiting portion is disposed correspondingly to the first lifting connecting rod; and/or wherein the seat surface mounting portion is provided with a third limiting portion, and the third limiting portion is disposed correspondingly to the fourth lifting connecting rod; and/or wherein the seat surface mounting portion is provided with a mounting member which is detachable from the seat surface mounting portion, the mounting member comprises a first sheet portion and a second sheet portion that is different from the first sheet portion, the first sheet portion is mounted on the seat surface mounting portion, and the second sheet portion is provided with a plurality of mounting holes.

20. An adjustment structure of a seat frame, comprising:

an elevation unit, comprising a support, a first elevation rod, a second elevation rod that is different from the first elevation rod, and a connecting piece, wherein a first end of the first elevation rod is hinged to the support, and a second end of the first elevation rod is hinged to the connecting piece; a first end of the second elevation rod is hinged to the support, and a second end of the second elevation rod is hinged to the connecting piece; and an extension unit, comprising a base plate, a lifting unit, a foot adjustment unit, and a backrest adjustment unit, wherein the base plate is fixed to the connecting piece;

wherein the lifting unit comprises a first lifting connecting rod, a second lifting connecting rod, a third lifting connecting rod, a fourth lifting connecting rod, and a seat surface mounting portion; the first lifting connecting rod, the second lifting connecting rod, the third lifting connecting rod, and the fourth lifting connecting rod are different from each other, a first end of the first lifting connecting rod is hinged to the base plate, a second end of the first lifting connecting rod is hinged to a first end of the third lifting connecting rod, a second end of the third lifting connecting rod is hinged to a first end of the seat surface mounting portion, a second end of the seat surface mounting portion is hinged to a first end of the fourth lifting connecting rod, a second end of the fourth lifting connecting rod is hinged to a first end of the second lifting connecting rod, and a second end of the second lifting connecting rod is connected to the base plate; the first lifting connecting rod and the second lifting connecting rod are hinged at a first rotating fulcrum, and the first rotating fulcrum is located in a middle region of at least one of the first lifting connecting rod or the second lifting connecting rod.

* * * * *